US005335209A

United States Patent [19]

Jaenke et al.

[11] Patent Number: 5,335,209

[45] Date of Patent: Aug. 2, 1994

[54] ACOUSTIC SENSOR AND PROJECTOR MODULE HAVING AN ACTIVE BAFFLE STRUCTURE

[75] Inventors: Paul E. Jaenke, Arnold; Larry T. Gingerich, Annapolis, both of Md.

[73] Assignee: Westinghouse Electric Corp., Pitsburgh, Pa.

[21] Appl. No.: 57,382

[22] Filed: May 6, 1993

[51] Int. Cl.[5] ..... H04R 17/00

[52] U.S. Cl. ..... 367/155; 367/162; 367/176; 367/140; 310/326; 310/337

[58] Field of Search ..... 367/155, 162, 176, 153, 367/140; 310/326, 327, 337; 128/662.03, 663.01, 24 AA; 181/104

[56] References Cited

U.S. PATENT DOCUMENTS

| | | | |
|---|---|---|---|
| 2,746,026 | 5/1956 | Camp | 367/155 |
| 3,409,869 | 11/1968 | McCool et al. | 367/162 |
| 3,480,906 | 11/1969 | Thompson | 367/162 |
| 4,004,266 | 1/1977 | Cook et al. | 367/162 |
| 4,158,189 | 6/1979 | Wardle | 367/162 |
| 4,166,967 | 9/1979 | Benes et al. | 310/338 |
| 5,175,709 | 12/1992 | Slayton et al. | 367/90 |

*Primary Examiner*—J. Woodrow Eldred

[57] ABSTRACT

An acoustic sensor and projector module for sonar applications includes a first acoustic transducer element operating as a projector to generate an acoustic beam, and a second acoustic transducer element acting as a hydrophone to sense pressure wave returns. When the second acoustic transducer element operates in a sensing mode, the first acoustic transducer element serves in conjunction with a baffle structure to baffle acoustic signals presented to the hydrophone. Similarly, when the first transducer element operates in a projecting mode to generate an acoustic beam, the second transducer element acts in combination with a baffle structure to baffle acoustic signals emitted by the projector.

19 Claims, 2 Drawing Sheets

ACOUSTIC SENSOR AND PROJECTOR MODULE HAVING AN ACTIVE BAFFLE STRUCTURE

BACKGROUND OF THE INVENTION

1. Field of the Invention

The present invention relates to acoustic transducers. More particularly, the present invention relates to an acoustic sensor and projector module for sonar applications.

2. Description of Related Art

Sonar search systems employ arrays of acoustic transducer modules to sense pressure wave returns from underwater targets. Acoustic transducer modules include oscillatory transducer elements that project acoustic beams when electrically excited, and which generate electrical signals in response to acoustic energy. Thus, such a transducer element can be used in sonar systems as either a projector for generating acoustic beams, or as a hydrophone for sensing acoustic wave returns. However, an acoustic transducer element cannot simultaneously be used both as a hydrophone and as a projector.

To sense acoustic signals at selected wavelengths, sonar transducer modules include acoustic baffles that enable the transducer element to receive signals at the desired wavelength, but which attenuate, or "baffle," unwanted noise. One type of baffling arrangement is a ¼ wave baffle design comprising layers of high and low acoustic impedance materials surrounding three sides of the acoustic transducer element. The thickness of each layer is selected to correspond to a ¼ wavelength of sound, as determined by the speed of sound within the particular material.

The layered baffle structure provides a very lossy composite baffle that serves to attenuate unwanted acoustic noise from all directions other than the desired one, significantly increasing the directivity index (DI) of the acoustic transducer element. By carefully selecting the dimensions of each of the layers, the baffle can be configured to reflect the desired signal back in phase to the transducer element. The reflected signals improve the sensitivity of the transducer element by constructively adding to the signal. At the same time, the unwanted noise can be made to cancel itself, thereby further reducing the noise level of the transducer element.

Most side looking search sonar systems require two distinct arrays of acoustic transducer modules dedicated to projecting and sensing, respectively. In sonar systems of this type, one set of acoustic transducer modules forms a projector array that directs an acoustic beam at the target, and another group of acoustic transducer modules serves as a hydrophone array for sensing pressure waves returned from the target. The projector and hydrophone arrays are commonly housed together in a common metal frame that is sealed and filled with an acoustic fill fluid. Acoustic transducer modules having the ¼ wave baffle design can be used to form both the projector and hydrophone arrays. However, the baffle structure increases the weight and volume of each module and, consequently, the weight and volume of each array of modules.

Increasingly aggressive mission requirements for sonar search systems have led to significant efforts to reduce the weight, volume, and power consumption of the overall sonar system. One possible way to achieve the desired reductions is to modify the design of the acoustic transducer modules. For example, a sonar system has been proposed that eliminates the need for distinct projector and hydrophone arrays, using a single array of modules for both projecting and sensing.

This technique, commonly called transmit/receive (T/R) switching, incorporates electronic circuitry that switches the individual transducer elements in a single array of modules between projecting and sensing modes of operation. However, the additional circuitry required by the T/R switching design undesirably increases the complexity of the overall sonar device. Moreover, the weight and volume added by the electronic components negate the savings achieved by elimination of the additional array of transducer modules. Accordingly, the need remains for a transducer module design realizing the goals of reduced weight and volume.

SUMMARY OF THE INVENTION

In light of the foregoing, the present invention provides an acoustic transducer module of reduced weight and volume for use in sonar search systems.

Additional advantages of the invention will be set forth in part in the description which follows, and in part will be obvious from the description, or may be learned by practice of the invention. The objects and advantages of the invention will be realized and attained by means of the elements and combinations particularly pointed out in the written description and claims, as well as the appended drawings.

To achieve the objects and in accordance with the purpose of the invention, as embodied and broadly described herein, the present invention is an acoustic sensor and projector module comprising a base acoustic baffle including at least one baffle layer, a first acoustic transducer element positioned on a surface of the base acoustic baffle, the first acoustic transducer element having first and second opposing sides, a second acoustic transducer element positioned on the surface of the base acoustic baffle, the second acoustic transducer element having first and second opposing sides, the first side of the second acoustic transducer element positioned opposite the first side of the first acoustic transducer element, a first side acoustic baffle including at least one baffle layer positioned on the surface of the base acoustic baffle adjacent the second side of the first acoustic transducer element, the first side acoustic baffle baffling acoustic signals projected or sensed by the first acoustic transducer element, and the first side acoustic baffle and the first acoustic transducer element baffling acoustic signals projected or sensed by the second acoustic transducer element, and a second side acoustic baffle including at least one baffle layer positioned on the surface of the base acoustic baffle adjacent the second side of the second acoustic transducer element, the second side acoustic baffle baffling acoustic signals projected or sensed by the second acoustic transducer element, and the second side acoustic baffle and the second acoustic transducer element baffling acoustic signals projected or sensed by the first acoustic transducer element.

It is to be understood that both the foregoing general description and the following detailed description are exemplary and explanatory only and are not restrictive of the invention, as claimed.

The accompanying drawings, which are incorporated in and constitute a part of this specification, illustrate various embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

According to the present invention, there is provided an acoustic sensor and projector module comprising a base acoustic baffle, a first acoustic transducer element, a second acoustic transducer element, a first side acoustic baffle, and a second side acoustic baffle.

With an acoustic sensor and projector module constructed according to the present invention, the projecting and sensing functions previously performed by two distinct arrays of transducer modules in other sonar systems can be performed by a single, dual-function array of transducer modules without the need for additional switching circuitry. Moreover, the first and second acoustic transducer elements in each module also form part of the module's acoustic baffle structure, providing an active baffling arrangement that further reduces the weight and volume of the device.

Figure 1:
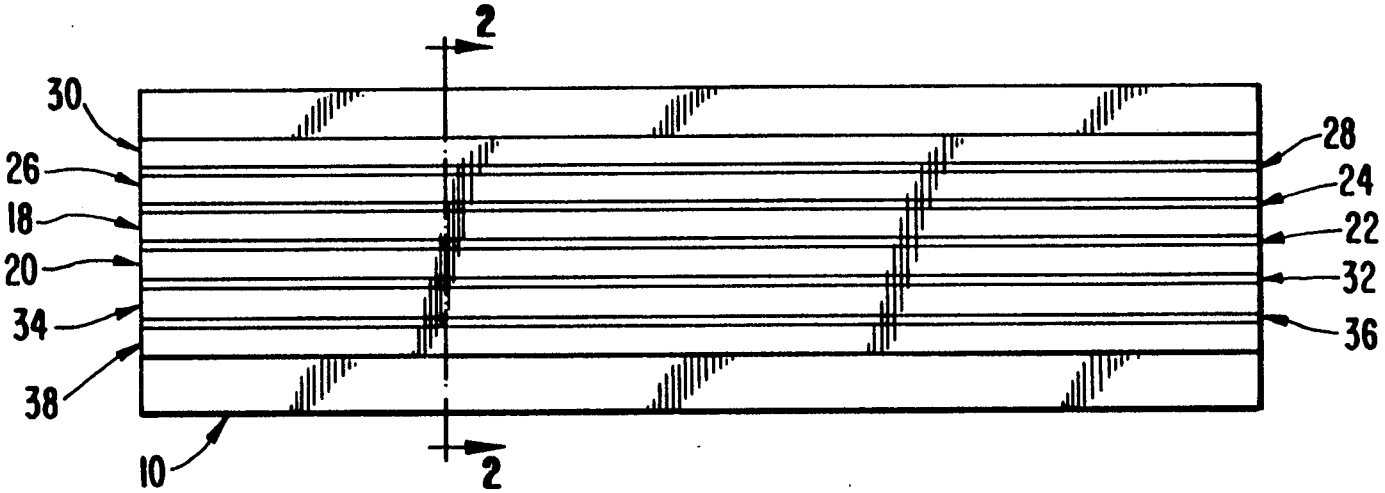
FIG. 1 is an overhead plan view of the acoustic sensor and projector module of the present invention.
Figure 2:
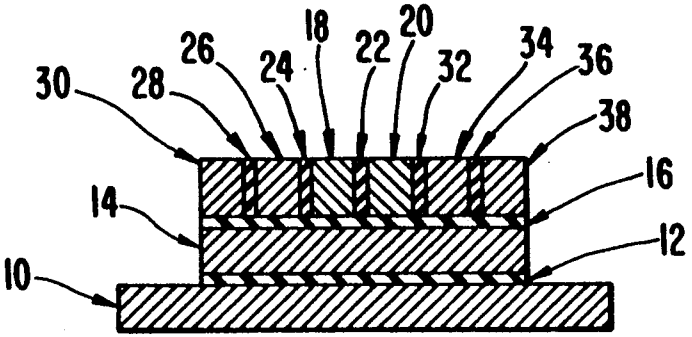
FIG. 2 is a cross-sectional view taken at line 2—2 of the acoustic sensor and projector module shown in FIG. 1.
Figure 3:
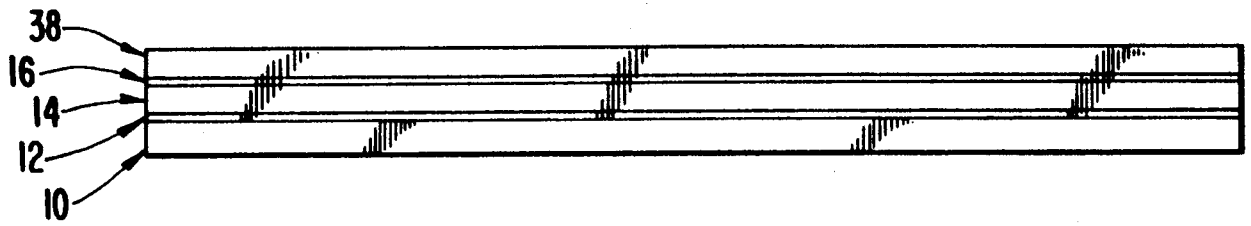
FIG. 3 is a side elevation view of the acoustic sensor and projector module shown in FIG. 1.

As herein embodied and shown in FIGS. 1, 2, and 3, the base acoustic baffle includes at least one baffle layer. For example, the base acoustic baffle may comprise two baffle layers 10, 14 formed of high acoustic impedance materials and two baffle layers 12, 16 formed of low acoustic impedance materials. The baffle layers 10, 12, 14, 16 are bonded together to form a first plurality of alternately stacked high and low acoustic impedance baffle layers extending in a vertical direction, with respect to FIG. 2.

Baffle layer 10, having a high acoustic impedance, is the bottom layer of the alternating stack, and is bonded to a bottom surface of low acoustic impedance baffle layer 12. The top surface of baffle layer 12 is bonded to a bottom surface of high acoustic impedance baffle layer 14, and a low acoustic impedance layer 16, bonded to baffle layer 14, forms the top layer of the base acoustic baffle. This alternately stacked arrangement of high and low acoustic impedance layers 10, 12, 14, 16 forms the base acoustic baffle on which the remainder of the acoustic sensor and projector module is situated.

The first acoustic transducer element 18 and second acoustic transducer element 20 are positioned adjacent one another on a top surface of the low acoustic impedance baffle layer 16 of the base acoustic baffle such that a first side of the first acoustic transducer element 18 is positioned opposite a first side of the second acoustic transducer element 20. At least one baffle layer separates the adjacent first sides of acoustic transducer elements 18 and 20. For example, as shown in FIG. 2, a low acoustic impedance baffle layer 22 is positioned on the surface of the base acoustic baffle between and in engagement with the first sides of the first and second acoustic transducer elements 18 and 20.

The first side acoustic baffle comprises at least one baffle layer positioned on the surface of layer 16 of the base acoustic baffle adjacent a second side of the first acoustic transducer element 18 opposing the first side of the first acoustic transducer element 18. The first side acoustic baffle includes a second plurality of alternately stacked high and low acoustic impedance baffle layers 24, 26, 28, 30 positioned on layer 16 of the base acoustic baffle, and extending laterally from the second side of the first acoustic transducer element 18.

The first side acoustic baffle includes an inner layer comprising a low acoustic impedance baffle layer 24 positioned on the base acoustic baffle adjacent the second side of the first acoustic transducer element 18. Layer 24 is bonded on a side opposing acoustic transducer element 18 to a high acoustic impedance baffle layer 26, which is bonded to a low acoustic impedance baffle layer 28. A high acoustic impedance layer 30, bonded to baffle layer 28, forms an outer layer of the first side acoustic baffle.

The second side acoustic baffle comprises at least one baffle layer positioned on the surface of layer 16 of the base acoustic baffle adjacent a second side of the second acoustic transducer element 20 opposing the first side of the second acoustic transducer element 20. The second side acoustic baffle includes a third plurality of alternately stacked high and low acoustic impedance baffle layers 32, 34, 36, 38 positioned on layer 16 of the base acoustic baffle, and extending laterally from the second side of the second acoustic transducer element 20.

A low acoustic impedance baffle layer 32 provides an inner layer of the second side acoustic baffle positioned adjacent the second side of the second acoustic transducer element 20. Baffle layer 32 is bonded on a side opposing the second acoustic transducer element 20 to a high acoustic impedance baffle layer 34, and a low acoustic impedance baffle layer 36 is bonded to an outer side of baffle layer 34. A high acoustic impedance baffle layer 38, bonded to baffle layer 36, forms an outer layer of the second side acoustic baffle.

Examples of suitable materials for fabrication of the high acoustic impedance baffle layers 10, 14, 26, 30, 34, 38 used to construct the base acoustic baffle and the first and second side acoustic baffles are stainless steel, titanium, machinable ceramic, or glass reinforced epoxy. The low acoustic impedance baffle layers 12, 16, 24, 28, 32, 36, as well as the low impedance baffle layer 22 separating the first and second acoustic transducer elements 18 and 20, may be formed, for example, of butyl rubber, polyurethane, or other rubber materials or elastomers.

The structure of the base acoustic baffle and first and second side acoustic baffles corresponds to the ¼ wave baffle design. Thus, each of the high and low acoustic impedance baffle layers has a thickness corresponding to a ¼ wavelength of sound transmitted through the layer, as determined by the speed of sound in the material used to fabricate the respective layer. Each of the high and low impedance layers in the baffles is bonded to adjacent layers with an epoxy or other cement-like material. Epoxy bonds are also made between the acoustic transducer elements 18 and 20 and the adjacent baffle layers 16, 22, 24, and 32.

In addition, alternating acoustic impedance baffle layers positioned on layer 16 of the base acoustic baffle are bonded to the top surface of layer 16 by epoxy. To maintain the precise dimensions of the ¼ wave design of the base acoustic baffle and first and second side acoustic baffles, the epoxy bonds separating adjacent layers should not be excessively thick. In particular, the thickness of the epoxy joints forming interfaces between the first acoustic transducer element 18 and layers 16, 22, and 24, and between acoustic transducer element 20 and layers 16, 22, and 32 should be held to a minimum.

Figure 4:
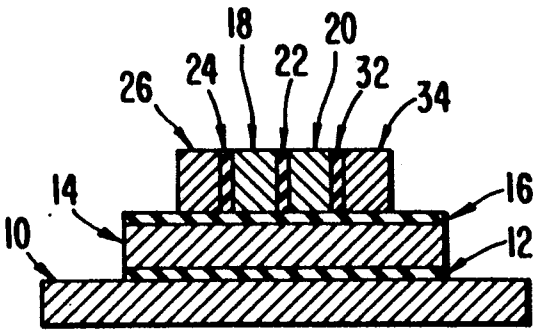
FIG. 4 is a cross-sectional view of a modification of the acoustic sensor and projector module shown in FIGS. 1-3.

FIG. 4 is an example of a modified acoustic sensor and projector module according to the present invention. The difference between the acoustic sensor and projector module shown in FIG. 4, relative to the that illustrated in FIG. 1-3, is that each of the first and second side acoustic baffles is realized by only a single-stage baffle structure. For example, the module shown in FIG. 1-3 includes two high acoustic impedance baffle layers and two low acoustic impedance baffle layers in each of the first and second side acoustic baffles. However, for some applications, a single pair of high and low acoustic impedance baffle layers in each side acoustic baffle may be sufficient to provide the desired attenuation of unwanted noise.

As shown in FIG. 4, the first side acoustic baffle comprises low acoustic impedance baffle layer 24 and high acoustic impedance baffle layer 26. The second side acoustic baffle is similarly constructed to include low acoustic impedance baffle layer 32 and high acoustic impedance baffle layer 34. The less complex baffle design of the module shown in FIG. 4 provides additional reductions in the weight and volume of the acoustic sensor and projector module for applications in which a lesser degree of attenuation is adequate.

The first and second acoustic transducer elements 18 and 20 can be formed from a poled piezo ceramic material, such as, for example, lead-zirconate-titanate (PZT) or piezo ceramic barium titanate, or from a piezo crystalline material, such as, for example, lithium niobate ($LINO_3$). Alternatively, a rubber material can be loaded with piezo ceramic particles to form a piezo rubber material suitable for use as an acoustic transducer element. If large transducer elements are required that may not readily be constructed from some transducer materials, each transducer element 18 and 20 can be formed by a pair of smaller transducer elements situated end-to-end on the base baffle.

Figure 5:
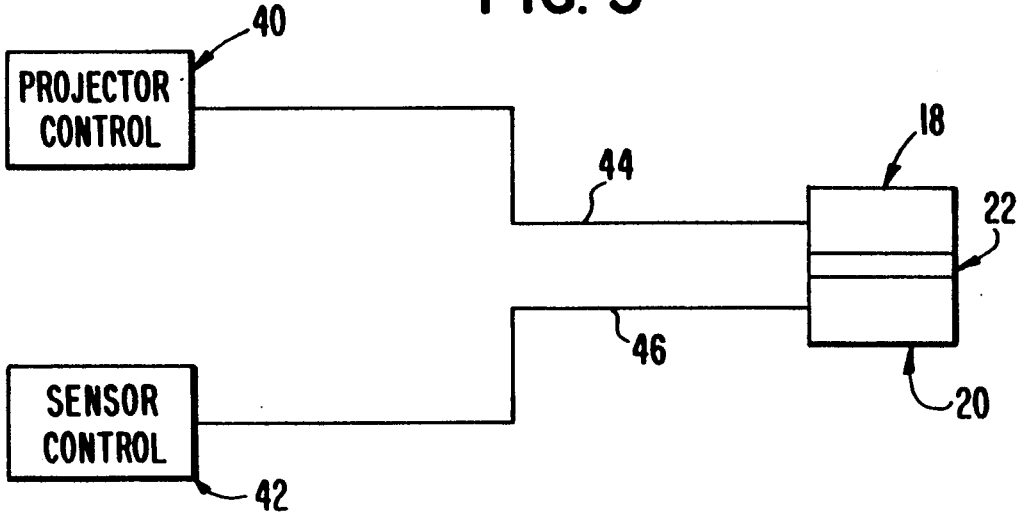
FIG. 5 is a functional block diagram illustrating connection of the acoustic sensor and projector module of the present invention to projecting and sensing control circuitry.

For sonar applications, electrodes (not shown) formed on the first acoustic transducer element 18 are coupled to a projector control circuit 40 in the sonar device via a cable 44, as shown in FIG. 5. The second acoustic transducer element 20 is connected via electrodes (not shown) to a sensor control circuit 42 by cable 46. When the projector control circuit 40 applies an electrical signal, the first acoustic transducer element 18 oscillates, emitting sound waves into the water. In response to pressure wave returns from underwater targets, the second acoustic transducer element 20 generates an electrical output that is amplified by the sensor control circuit 42.

Of course, the acoustic sensor and projector module can be constructed such that the roles of the acoustic transducer elements 18, 20 are reversed relative to those discussed above. For example, the electrodes of element 18 could be coupled to the sensor control circuit 42, whereas the electrodes of element 20 could be coupled to the projector control circuit 40. In either case, the combination of transducer elements 18 and 20 provides both an acoustic projector and sensor in a single, compact transducer module. As a result, a sonar system can be reduced to a single array of dual-function transducer modules, realizing substantial reductions in the weight and volume of the device, without the incorporation of additional switching circuitry.

As an example, two typical transducer modules necessary to perform both projecting and sensing can weigh approximately 0.55 pounds, whereas a dual-function transducer module constructed as shown in FIGS. 1-4 has been reduced to 0.27 pounds. Far greater than the savings achieved in the transducer arrays, however, are the reductions in the sonar device housing. Whereas the typical housing must be large enough to accommodate two parallel arrays of transducer modules, with a single array of acoustic projector and sensor modules incorporating the present invention, the volume of the housing can be reduced by approximately 40% with a corresponding weight savings. The amount of fill material in the housing can also be reduced by nearly the same proportion.

The acoustic projector and sensor module of the present invention provides further reductions in the weight and volume of the sonar device by employing an active baffling arrangement in which each of the first and second active acoustic transducer elements 18 and 20 performs a dual role. For example, when the first acoustic transducer element 18 operates in either a projecting or sensing mode, the acoustic signals emitted or received by the first acoustic transducer element 18 are baffled on one side by the base acoustic baffle and on another side by the first side acoustic baffle. At the same time, however, the second acoustic transducer element 20 acts in conjunction with the second side acoustic baffle and the low acoustic impedance baffle layer 22 to baffle the acoustic signals at the corresponding side of the first acoustic transducer element 18.

Similarly, when the second transducer element 20 operates either as a hydrophone to sense pressure wave returns, or as a projector to emit pressure waves, the second side acoustic baffle and the base acoustic baffle serve to baffle acoustic signals received or projected at the respective sides of the module. The first acoustic transducer element 18 acts in conjunction with the first side acoustic baffle and the low acoustic impedance baffle layer 22 to baffle the acoustic signals received or projected at the corresponding side of the module. Thus, in this manner, active acoustic transducer elements 18 and 20 perform projecting and sensing functions, and also act in a passive capacity to form part of the baffling structure of the module, reducing the weight and volume of the module.

The first and second acoustic transducer elements 18 and 20 each form a high acoustic impedance baffle layer for the respective composite baffle, and are each dimensioned, consistent with the active ¼ wave baffle design, to a thickness corresponding to a ¼ wavelength of sound in the material used to fabricate the transducer elements. Acoustic transducers modules incorporating the active ¼ wave baffle design of the present invention can be constructed for a wide range of frequencies, subject only to the practical manufacturing limitations arising with respect to fabrication of the acoustic transducer elements 18, 20.

In operation, the first acoustic transducer element 18 acts in combination with the second plurality of alternately stacked high and low acoustic impedance baffle layers 24, 26, 28, 30 and with low acoustic impedance baffle layer 22, to form a composite baffle for baffling the active second transducer element 20. In addition, when the first acoustic transducer element 18 is active, the second acoustic transducer element 20 serves as part of a composite baffle comprising the third plurality of alternately stacked high and low acoustic impedance baffle layers 32, 34, 36, 38 and low acoustic impedance baffle layer 22 to baffle the acoustic signals projected or sensed by the first acoustic transducer element 18. Thus, baffle layer 22, which separates the first and second acoustic transducer elements 18 and 20, forms part of both composite baffles.

Having described the presently preferred embodiments of the invention, additional advantages and modifications will readily occur to those skilled in the art from consideration of the specification and practice of the invention disclosed herein. It is intended that the specification and examples be considered as exemplary only, with a true scope and spirit of the invention being indicated by the following claims.

We claim:

1. An acoustic sensor and projector module comprising:

a base acoustic baffle including at least one baffle layer;

a first acoustic transducer element, positioned on a surface of said base acoustic baffle, for projecting acoustic signals, said first acoustic transducer element having first and second opposing side planes;

a second acoustic transducer element, positioned on said surface of said base acoustic baffle, for sensing acoustic signals, said second acoustic transducer element having first and second opposing side planes, said first side plane of said second acoustic transducer element positioned opposite said first side plane o said first acoustic transducer element;

a first side acoustic baffle including at least one baffle layer positioned on said surface o said base acoustic baffle, said first side acoustic baffle having a first side plane in engagement with said second side plane of said first acoustic transducer element, said first side acoustic baffle baffling the acoustic signals projected by said first acoustic transducer element, and said first side acoustic baffle and said first acoustic transducer element baffling the acoustic signals sensed by said second acoustic transducer element; and a second side acoustic baffle including at least one baffle layer positioned on said surface of said base acoustic baffle, said second side acoustic baffle having a first side plane in engagement with said second side plane of said second acoustic transducer element, said second side acoustic baffle baffling the acoustic signals sensed by said second acoustic transducer element, and said second side acoustic baffle and said second acoustic transducer element baffling the acoustic signals projected by said first acoustic transducer element, wherein each of said base acoustic baffle, said first acoustic transducer element, said second acoustic transducer element, said first side acoustic baffle, and said second side acoustic baffle forms a ¼ wavelength acoustic baffle.

2. The acoustic sensor and projector module of claim 1, further comprising at least one central baffle layer positioned on said surface of said base acoustic baffle between said first acoustic transducer element and said second acoustic transducer element, said at least one central baffle layer having a first side plane in engagement with said first side plane of said first acoustic transducer element and a second side plane in engagement with said first side plane of said second acoustic transducer element, for baffling, in combination with said first acoustic transducer element and said first side acoustic baffle, said acoustic signals sensed by said second acoustic transducer element, and for baffling, in combination with said second acoustic transducer element and said second side acoustic baffle, said acoustic signals projected by said first acoustic transducer element.

3. The acoustic sensor and projector module of claim 2, wherein:

said at least one baffle layer of said base acoustic baffle includes a first plurality of alternately stacked high and low acoustic impedance baffle layers, said at least one baffle layer of said first side acoustic baffle includes a second plurality of alternately stacked high and low acoustic impedance baffle layers, said at least one baffle layer of said second side acoustic baffle includes a third plurality of alternately stacked high and low acoustics impedance baffle layers, and said at least one baffle layer positioned on said surface of said base acoustic baffle between and in engagement with said first side of said first acoustic transducer element and said first side of said second acoustic transducer element includes a low acoustic impedance baffle layer.

4. The acoustic sensor and projector module of claim 3, wherein one or more of said high acoustic impedance baffle layers in said base acoustic baffle, said first side acoustic baffle, and said second side acoustic baffle comprises stainless steel.

5. The acoustic sensor and projector module of claim 3, wherein one or more of said high acoustic impedance baffle layers in said base acoustic baffle, said first side acoustic baffle, and said second side acoustic baffle comprises a ceramic material.

6. The acoustic sensor and projector module of claim 3, wherein one or more of said high acoustic impedance baffle layers in said base acoustic baffle, said first side acoustic baffle, and said second side acoustic baffle comprises titanium.

7. The acoustic sensor and projector module of claim 3, wherein one or more of said high acoustic impedance baffle layers in said base acoustic baffle, said first side acoustic baffle, and said second side acoustic baffle comprises glass reinforced epoxy.

8. The acoustic sensor and projector module of claim 3, wherein said low acoustic impedance baffle layer positioned on said surface of said base acoustic baffle between and in engagement with said first side of said first acoustic transducer element and said first side of said second acoustic transducer element and one or more of said low acoustic impedance layers in said base acoustic baffle, said first side acoustic baffle, and said second side acoustic baffle comprises butyl rubber.

9. The acoustic sensor and projector module of claim 3, wherein said low acoustic impedance baffle layer positioned on said surface of said base acoustic baffle between and in engagement with said first side of said first acoustic transducer element and said first side of said second acoustic transducer element and one or more of said low acoustic impedance layers in said base acoustic baffle, said first side acoustic baffle, and said second side acoustic baffle comprises polyurethane.

10. The acoustic sensor and projector module of claim 1, wherein each of said first and second acoustic transducer elements comprises a piezo ceramic material.

11. The acoustic sensor and projector module of claim 1, wherein each of said first and second acoustic transducer elements comprises a piezo crystalline material.

12. The acoustic sensor and projector module of claim 1, wherein each of said first and second acoustic transducer elements comprises a piezo rubber material.

13. The acoustic sensor and projector module of claim 2, wherein said first and second side planes of said first acoustic transducer element, said first and second side planes of said second acoustic transducer element, said first side plane of said first side acoustic baffle, said first side plane of said second side acoustic baffle, and said first and second side planes of said at least one central baffle layer are rectangular.

14. The acoustic sensor and projector module of claim 2, wherein said first acoustic transducer element includes a rectangular projecting side plane opposite said base acoustic baffle, and said second acoustic transducer element includes a rectangular sensing side plane opposite said base acoustic baffle.

15. An acoustic sensor and projector module comprising:

a base acoustic baffle including at least one baffle layer having a top surface;

a first acoustic transducer element, positioned on said top surface of said base acoustic baffle, for projecting acoustic signals, said first acoustic transducer element having first and second opposing side planes;

a second acoustic transducer element, positioned on said top surface of said base acoustic baffle, for sensing acoustic signals, said second acoustic transducer element having first and second opposing side planes, said first side plane of said second acoustic transducer element positioned opposite said first side plane of said first acoustic transducer element;

a first side acoustic baffle including at least one baffle layer positioned on said top surface of said base acoustic baffle and having a first side plane in engagement with said second side plane of said first acoustic transducer element;

a second side acoustic baffle including at least one baffle layer positioned on said top surface of said base acoustic baffle and having a first side plane in engagement with said second side plane of said second acoustic transducer element; and a central acoustic baffle including at least one baffle layer positioned on said top surface of said base acoustic baffle between said first acoustic transducer element and said second acoustic transducer element, said central acoustic baffle having a first side plane in engagement with said first side plane of said first acoustic transducer element and a second side plane in engagement with said first side plane of said second acoustic transducer element, wherein said first acoustic transducer element, said central acoustic baffle, said firs side acoustic baffle, and said second side acoustic baffle serve to baffle said acoustic signals sensed by said second acoustic transducer element, and said second acoustic transducer element, said central acoustic baffle, said first side acoustic baffle, and said second side acoustic baffle serve to baffle said acoustic signals projected by said first acoustic transducer element.

16. The acoustic sensor and projector module of claim 15, wherein:

said at least on baffle layer of said base acoustic baffle includes a first plurality of alternately stacked high and low acoustic impedance baffle layers, said at least one baffle layer of said first side acoustic baffle includes a second plurality of alternately stacked high and low acoustic impedance baffle layers, said at least one baffle layer of said second side acoustic baffle includes a third plurality of alternately stacked high and low acoustic impedance baffle layers, and said at least one baffle layer of said central acoustic baffle includes a low acoustic impedance baffle layer.

17. The acoustic sensor and projector module of claim 15, wherein each of said base acoustic baffle, said first acoustic transducer element, said second acoustic transducer element, said first side acoustic baffle, said second side acoustic baffle, and said central acoustic baffle forms a ¼ wavelength acoustic baffle.

18. The acoustic sensor and projector module of claim 15, wherein said first and second side planes of said first acoustic transducer element, said first and second side planes of said second acoustic transducer element, said first side plane of said first side acoustic baffle, said first side plane of said second side acoustic baffle, and said first and second side planes of said central acoustic baffle are rectangular.

19. The acoustic sensor and projector module of claim 15, wherein said first acoustic transducer element includes a rectangular projecting side plane opposite said base acoustic baffle, and said second acoustic transducer element includes a rectangular sensing side plane opposite said base acoustic baffle.

* * * * *